US007574822B1

(12) United States Patent
Moore

(10) Patent No.: US 7,574,822 B1
(45) Date of Patent: Aug. 18, 2009

(54) ILLUMINATED LABEL HOLDERS AND RELATED MERCHANDISE DISPLAY SYSTEMS

(76) Inventor: Harold A. Moore, 141 Saint Vincent, Irvine, CA (US) 92618

( * ) Notice: Subject to any disclaimer, the term of this patent is extended or adjusted under 35 U.S.C. 154(b) by 77 days.

(21) Appl. No.: 11/364,935

(22) Filed: Feb. 28, 2006

Related U.S. Application Data

(60) Provisional application No. 60/661,699, filed on Mar. 14, 2005.

(51) Int. Cl.
*G09F 3/18* (2006.01)

(52) U.S. Cl. ..... 40/661.03; 40/575

(58) Field of Classification Search ..... 40/661.03, 40/579, 661.103
See application file for complete search history.

(56) References Cited

U.S. PATENT DOCUMENTS

| | | | | | |
|---|---|---|---|---|---|
| 3,084,463 | A * | 4/1963 | Guyer et al. | ..... | 40/564 |
| 3,086,308 | A * | 4/1963 | Ternouth | ..... | 40/541 |
| 3,248,494 | A * | 4/1966 | Barnes | ..... | 200/51 R |
| 4,934,645 | A | 6/1990 | Breslow | ..... | 248/242 |
| 5,220,739 | A * | 6/1993 | Chich et al. | ..... | 40/564 |
| 5,688,042 | A * | 11/1997 | Madadi et al. | ..... | 362/240 |
| 5,726,535 | A * | 3/1998 | Yan | ..... | 315/185 R |
| 5,738,019 | A | 4/1998 | Parker | ..... | 108/108 |
| 5,924,367 | A | 7/1999 | Henke et al. | ..... | 108/108 |
| 6,041,720 | A | 3/2000 | Hardy | ..... | 108/60 |
| 6,470,613 | B1 | 10/2002 | Wildrick | ..... | 40/661.03 |
| 6,638,088 | B1 | 10/2003 | Richardson | ..... | 439/242 |
| 6,688,567 | B2 | 2/2004 | Fast et al. | ..... | 248/220.41 |
| 6,827,465 | B2 | 12/2004 | Shemitz et al. | ..... | 362/125 |
| 6,935,061 | B2 | 8/2005 | Thompson | ..... | 40/661.03 |
| 6,971,201 | B2 | 12/2005 | Brinkman et al. | ..... | 40/642.02 |
| 2002/0147597 | A1 | 10/2002 | Connors et al. | ..... | 705/1 |

* cited by examiner

*Primary Examiner*—Cassandra Davis
(74) *Attorney, Agent, or Firm*—Stout, Uxa, Buyan & Mullins, LLP; Greg S. Hollrigel; Linda A. Fox

(57) ABSTRACT

Label holders include a label retention member and an illumination source positioned relative to the label retention member to provide back lighting to one or more labels retained by the label retention member. The label holders hold labels which include information readable by a consumer or other person or computerized device, such as merchandising information and the like. The label holders can be attached to or near a front edge of a shelf, such as a gondola shelf, or can be provided as a stand alone sign or top spanner sign. The illumination source can include a plurality of low voltage bright illumination devices, such as light emitting diodes. Merchandise display systems including, methods of making, and methods of using the present label holders are also described.

17 Claims, 6 Drawing Sheets

ILLUMINATED LABEL HOLDERS AND RELATED MERCHANDISE DISPLAY SYSTEMS

CROSS-REFERENCE TO RELATED APPLICATIONS

This application claims the benefit of U.S. Provisional Application No. 60/661,699, filed Mar. 14, 2005, the content of which is hereby incorporated by reference in its entirety.

FIELD OF THE INVENTION

The present invention relates generally to label holding devices and merchandise display systems. More particularly, the invention relates to label holders and merchandise display systems which provide backlighting to one or more labels provided with the label holders.

BACKGROUND

Retailers and other merchandise outlets, such as supermarkets, pharmacies, department stores, convenience stores, and the like, use shelving assemblies to display merchandise, such as boxed items, cans, bottles, and other packages. These shelving assemblies typically include a front edge or front edge surface that retains labels or tags that have information pertaining to the merchandise located on a shelf of the shelving assembly. Examples of such shelving assemblies are referred to as gondola shelves. Examples of shelf assemblies, including gondola shelf assemblies, include those described in U.S. Pat. Nos. 4,934,645; 5,738,019; and 6,041,720. Gondola shelves or gondola shelf assemblies are often understood to include a base shelf, a plurality of vertical uprights extending from the base shelf, and one or more additional shelves adjustably connected to the vertical uprights. Gondola shelf assemblies may also include a backing extending between two uprights, and additional optional equipment used to secure the shelving assembly to solid structures, such as walls and the like.

Shelf assemblies, including gondola shelf assemblies, often include a C-channel along the front edge of the shelf. The C-channel is structured to hold one or more merchandise information articles, such as labels, tags, and the like, that provide information about the merchandise located on the shelf. These merchandise information articles can be adhesively secured to the front edge of the shelf, including in the C-channel, or may be placed in the C-channel and can be moved along the length of the C-channel. The front edge of the shelf and the C-channel can be understood to be label or tag holders since they can retain one or more labels or tags which have merchandise information. In addition, label or tag holders have been described in patents, including U.S. Pat. Nos. 5,924,367; 6,470,613; 6,688,567; 6,935,061; and 6,971,201.

Attempts have been made to influence the sale or purchase of certain or select merchandise by providing enlarged displays, flags, or other signs near the merchandise to increase the visibility or draw a consumer's attention to that merchandise. However, these types of displays can waste merchandise space, can become dislodged from the shelves, and can cause injury to consumers or other people passing by the displays. Thus, there remains a need for new label holders and merchandise display systems including such label holders that reduce one or more problems associated with existing systems.

SUMMARY

The present devices, systems, and methods attempt to address this and other needs. Label holders are described that include an illumination source or illumination component. The present label holders can improve or enhance a consumer's shopping experience relative to existing systems and label holders, including non-illuminated shelving systems and label holders. The illumination source can visually enhance information displayed on labels or tags making the information, and the labels/tags which include the information, easier to read compared to non-illuminated labels/tags. As used herein, labels and tags are used interchangeably and can be understood to refer to articles that include merchandise information, such as merchandise price, merchandise descriptions, barcodes, and other inventory control information, as well as any other information, including text, numbers, graphics, and computer readable information. In other words, the labels or tags can be understood to be merchandise information display articles. The illumination source can also be effective in enhancing the display or appearance of merchandise located near the illumination source, and in attracting consumers to select merchandise.

Lighting can influence consumer behavior in purchasing merchandise. For example, different lighting conditions can affect a consumer's movement past merchandise, can influence whether a consumer makes visual contact with select merchandise, can influence consumer browsing times, and can influence whether a consumer purchases the select merchandise. For example, whereas only 12% of consumers may glance at non-illuminated end cap displays, illuminated end cap displays can result in more than 20% of consumers glancing at the merchandise displayed thereon. In addition, illumination of merchandise of an end cap display can increase the browsing rate by consumers by about 80% or more, and can double the sales of merchandise by the browsing consumers. In certain embodiments of the present label holders and merchandise display systems, the illumination source is effective in illuminating one or more labels and merchandise located on a shelf below the label holder. The illumination source of the present label holders can reduce the time for a consumer to locate a desired product by enhancing visualization of the merchandise information, the merchandise, or a combination thereof. Thus, with the present label holders, consumer traffic and merchandise sales can be increased compared to non-illuminated label holders and merchandise display systems.

In addition or alternatively, the present label holders can increase the visibility of select merchandise to consumers without wasting merchandise space, becoming dislodged from the shelves, and/or injuring consumers or people passing by the displays, among other things.

The present label holders, as described in more detail herein, include a label retention member and an illumination source. The illumination source is positioned relative to the label retention member to provide backlighting to one or more labels located on or in the label retention member. In certain embodiments, the label holder includes a shelf retention member effective in securing the label holder to or near a front edge of shelf, such as a gondola shelf. The illumination source of shelf mounted label holders may also be positioned to provide light on or towards merchandise located near the illumination source, such as on a shelf located immediately below the label shelf on which the label holder is located. In other embodiments, the label holder is not structured to be retained on or near a shelf front edge. For example, the label holder may include a base structured to hold or support the label holder at a position other than the front edge of a shelf. Such label holders may be understood to be top spanners or stand alone signs.

Embodiments of the present invention also include merchandise display systems, such as shelving assemblies, including gondola shelf assemblies, that include one or more of the present label holders.

Embodiments of the present invention also include methods of producing a merchandise display system, which includes placing one or more of the present label holders on one or more portions of a shelving assembly. Embodiments also include methods of increasing sales of merchandise using the present label holders and merchandise display systems.

Any feature or combination of features described herein are included within the scope of the present invention provided that the features included in any such combination are not mutually inconsistent as will be apparent from the context, this specification, and the knowledge of one of ordinary skill in the art. In addition, any feature or combination of features may be specifically excluded from any embodiment of the present invention. Additional advantages and aspects of the present invention are apparent in the following drawings, detailed description, and claims.

DETAILED DESCRIPTION

Figure 1:
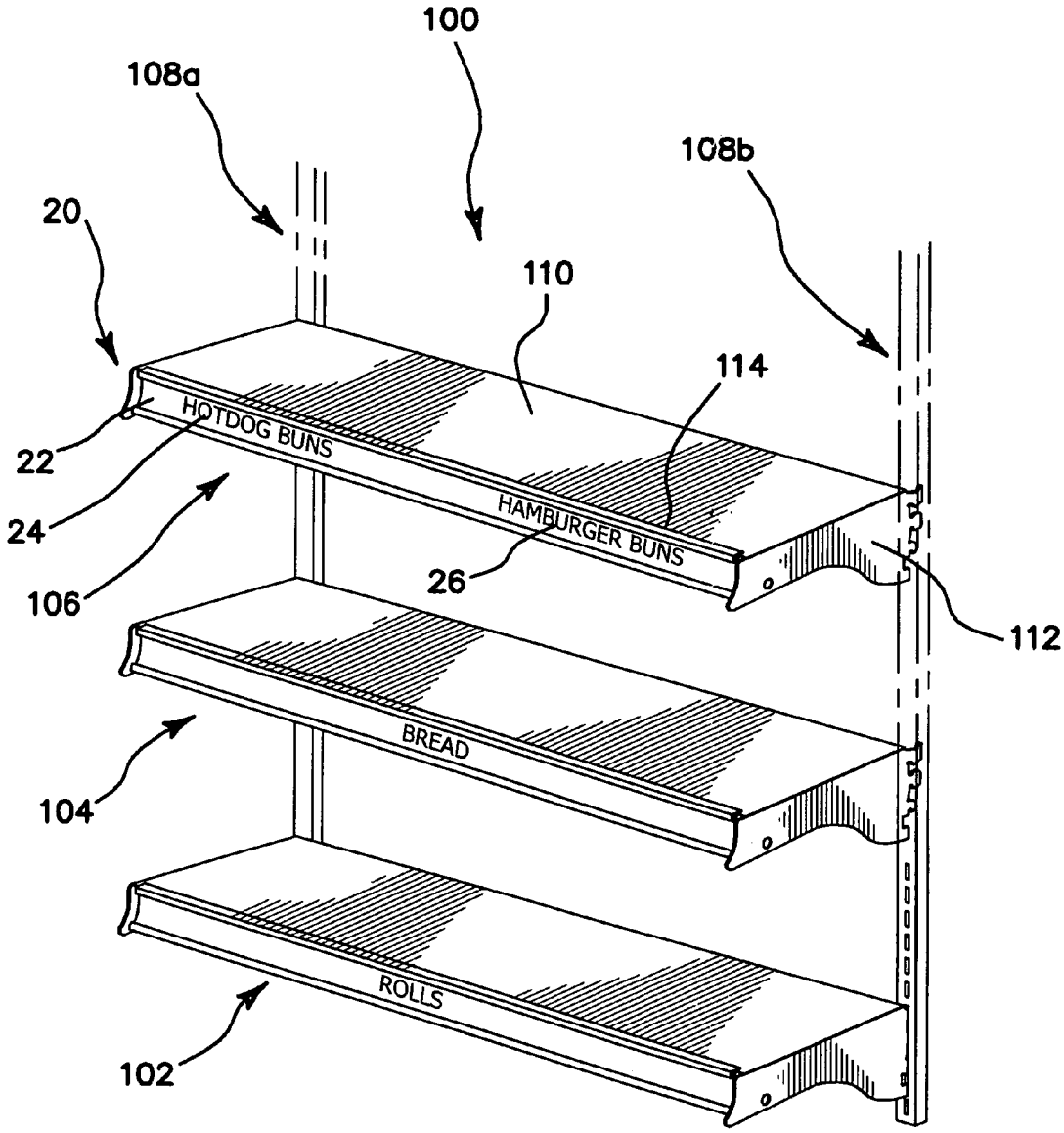
FIG. 1 is a perspective view of a shelving assembly or shelf system that includes three shelves and the present label holders attached to the front edge of the shelves.

Label holders have been invented that include a label retention member and an illumination source. The illumination source is positioned relative to the label retention member to provide backlighting to one or more labels located on or in the label retention member. One or more labels provided on or in the present label holders, and information provided on the labels, are visually and/or aesthetically enhanced by providing illumination projected toward the back or rear surface of the labels. Information provided on labels provided with the present label holders can be easier to read and easier to identify from a distance relative to non-illuminated labels. In addition, the illumination of the labels can attract consumers to desired merchandise located near the illuminated labels. For example, with the illuminated labels, it is possible to direct a consumer to a particular merchandise product compared to other merchandise products that are not associated with illuminated labels.

Backlit illumination of labels provided on or in the present label holders refers to illumination that originates from one or more light emitting devices positioned behind the labels provided on or in the present label holders. The light emitting devices may be positioned above, in line with, and/or below the labels of the label holders. For example, light emitting devices may be located above a horizontal line passing through the label, may be located on such a horizontal line, may be located below such a horizontal line, and combinations thereof if multiple light emitting devices are provided. In addition, the light emitting devices may be understood to be positioned behind or rearwardly spaced from the label retention member of the present label holders, and may be vertically positioned at any appropriate position to provide a desired backlit illumination. Other forms of illumination, such as front-lighting or side-lighting, are not precluded from use with the present label holders so long as backlighting is provided by the illumination source of the label holder.

The illumination source of the present label holders generates high intensity or bright light with reduced heat relative to incandescent or fluorescent light emitting devices that emit high intensity or bright light. The illumination sources can generate high intensity or bright light with relatively low voltage, such as compared to incandescent and fluorescent lights. In addition, the illumination source of embodiments of the present label holders do not include toxic gases or neon gases, and are not easily damaged compared to other incandescent and fluorescent light emitting devices. As described herein, embodiments of the present label holders, including the illustrated embodiments, include an illumination source that includes one or more light emitting diodes (LEDs).

The illumination source of the present label holders also may have a longer or greater life expectancy relative to incandescent, fluorescent or neon light bulbs. The illumination source of the present label holders can provide reduced maintenance, including maintenance costs, and reduced energy costs, relative to fluorescent, neon, and incandescent light sources. The illumination source works efficiently and generates bright light in hot and cold environments. The illumination source of the present label holders is configured to provide illumination that is inviting or attractive to a consumer and is not intrusive or does not act as a deterrent to the consumer. For example, the illumination source may project light by about one to three feet from the illumination source. The brightness of the illumination source can be easily controlled. In certain embodiments, including the illustrated embodiments, the brightness of the illumination source can be controlled by varying the density of light emitting devices without varying the wattage of the illumination source or the number of light emitting devices provided with the label holders.

The present label holders are structured, such as sized, shaped, and otherwise configured, for placement on or near merchandise or merchandise products. In certain embodiments, the present label holders are structured for placement on or near a shelf front edge, such as a gondola shelf front edge. Such embodiments may extend along the entire length of the shelf, or along a portion of the shelf. Other embodiments of the present label holders are structured for placement on regions other than the front edge of a shelf. For example, such label holders may be understood to be stand alone label holders and can be placed on a shelf without actually immobilizing the label holder on the shelf. Certain standalone label holders include an integral or attachable base member which can help stabilize the label holder near merchandise. Examples of such stand alone label holders include top spanner signs or gondola shelf header signs and other stand alone signs, such as signs not provided on a shelf, including a gondola shelf.

The present label holders have a length which corresponds to a desired placement location for appropriate merchandise. For example, an embodiment of the present label holders may have a length of about one foot, about two feet, about three feet, about four feet, about eight feet, or more. The present label holders have a height which corresponds to the height of desired labels to be provided on the label holders. For example, embodiments of the present label holders may have a height of about one inch, about two inches, about three inches, about four inches, about five inches or more. Certain specific embodiments are described herein. Frequently, the height of the label holder will be greater than the height of a label to be provided with the label holder.

The present label holders include a label retention member structured, such as sized, shaped, and/or configured, to retain one or more labels. The labels include readable information including machine readable information and/or human readable information. For example, labels can include information selected from the group consisting of text, numbers, graphics, photographs, and combinations thereof. Examples of information provided on the labels includes price information, logos, company information, including company name, brand name, bar codes, product information, such as unit size, and the like. The labels are transparent or translucent labels. In other words, the labels can transmit at least a portion of the light emitted from the illumination source of the label holders. Examples of suitable materials for producing the present labels include polyester or vellum films. Information provided on the labels can be printed on the label material using a UPC bar code reader/printer, an ink jet printer, or a laser jet printer, and other similar printing devices. The printing devices, including ink jet printers and laser jet printers, can be operatively connected to a computer, such as personal computer, that can provide instructions to print desired information on the label materials. With the present label holders, the labels described herein can be illuminated and secured on or in the label holder with minimal, and preferably no, information distortion. Using conventional personal computers, printers, and related equipment, the labels can be provided with information of any type typically printable by a computer controlled printer. For example, the labels can be provided with text of different font sizes, styles, and color. For example, the information can be provided in black, red, yellow, blue, green, orange, purple, and other suitable colors. The information to be printed can be entered into a template or other suitable medium using a conventional word processor program provided on a computer. With the present printing techniques, it is possible to ensure that the information is printed in straight lines and is otherwise properly aligned to provide an aesthetically pleasing label.

The labels have heights corresponding to the heights of the label holders with which they are to be held. For example, the labels can have heights of about one inch, about two inches, about three inches, about four inches, about five inches or more. In certain embodiments, a label has a height of 1.250 inches. In other embodiments, a label has a height of 2.125 inches. In other embodiments, a label has a height of 4.250 inches. Such labels are easily formattable on transparent or translucent label media available in sheets having a length of 11 inches and a width of 8.5 inches. The labels of an individual sheet of label film can be separated by perforation lines between adjacent labels. In addition, the present labels have a front or first surface, and a rear or second opposing surface. The information described herein is typically provided on the front surface, but in certain embodiments, the text may be provided on the rear surface. The label may also include an adhesive to facilitate attachment to the label retention member of the present label holders. For example, the label may include an adhesive on its rear surface. However, certain embodiments of the labels are free of adhesive.

Reference will now be made in detail to the presently illustrated embodiments of the invention. Wherever possible, the same or similar reference numbers are used in the drawings and the description to refer to the same or like parts. It should be noted that the drawings are in simplified form and are not to precise scale. In reference to the disclosure herein, for purposes of convenience and clarity only, directional terms, such as, top, bottom, left, right, up, down, over, above, below, beneath, rear, front, distal, and proximal are used with respect to the accompanying drawings. Such directional terms should not be construed to limit the scope of the invention in any manner.

Although the disclosure herein refers to certain illustrated embodiments, it is to be understood that these embodiments are presented by way of example and not by way of limitation. The intent of the following detailed description, although discussing exemplary embodiments, is to be construed to cover all modifications, alternatives, and equivalents of the embodiments as may fall within the spirit and scope of the invention as defined by the appended claims.

The present label holders include or comprise a label retention member, and an illumination source that is positioned relative to the label retention member to provide backlighting to at least one label located on or in the label retention member.

An embodiment of the present label holders is illustrated in FIG. 1. FIG. 1 illustrates a portion of a gondola shelf system 100. The gondola shelf system 100 is illustrated with a first gondola shelf 102, a second gondola shelf 104, and a third gondola shelf 106. The first, second, and third gondola shelves are attached to two vertical uprights 108*a* and 108*b*. Additional conventional gondola shelf components such as a backing, and base shelf, and the like, can be provided with the present gondola shelf system 100, but are not illustrated in FIG. 1 since such components are conventional and known by persons of ordinary skill in the art.

Reference will now be made to the label holder provided on shelf 106. It will be appreciated that the description of the label holder provided on shelf 106 can similarly apply to the label holders provided on the other shelves of the shelving system, such as shelves 102 and 104. Shelf 106 has a top surface 110 and two supporting elements 112 (only one of which is shown in FIG. 1). Shelf 106 is coupled or attached to the vertical uprights 108*a* and 108*b* by the supporting elements 112. Shelf 106 also includes a front edge 114, to which a label holder 20 is attached or coupled. As discussed herein, the attachment can be of obtained by any suitable attachment device. For example, the label holder can be adhesively attached to the shelf, or attached by way of a magnet, a fastener, or a pressure fit between a component of the label holder and the shelf itself.

Label holder 20 includes a label retention member 22 which is illustrated as including a first label 24 and a second label 26. As shown for the other shelves illustrated in FIG. 1, the label retention member can be provided with one label, or can be provided with more than two labels. The information provided on the labels can be provided in multiple portions of one long label that spans the length of the label retention member, or can be provided as separate labels that can be individually placed on or in the label retention member.

Figure 2:
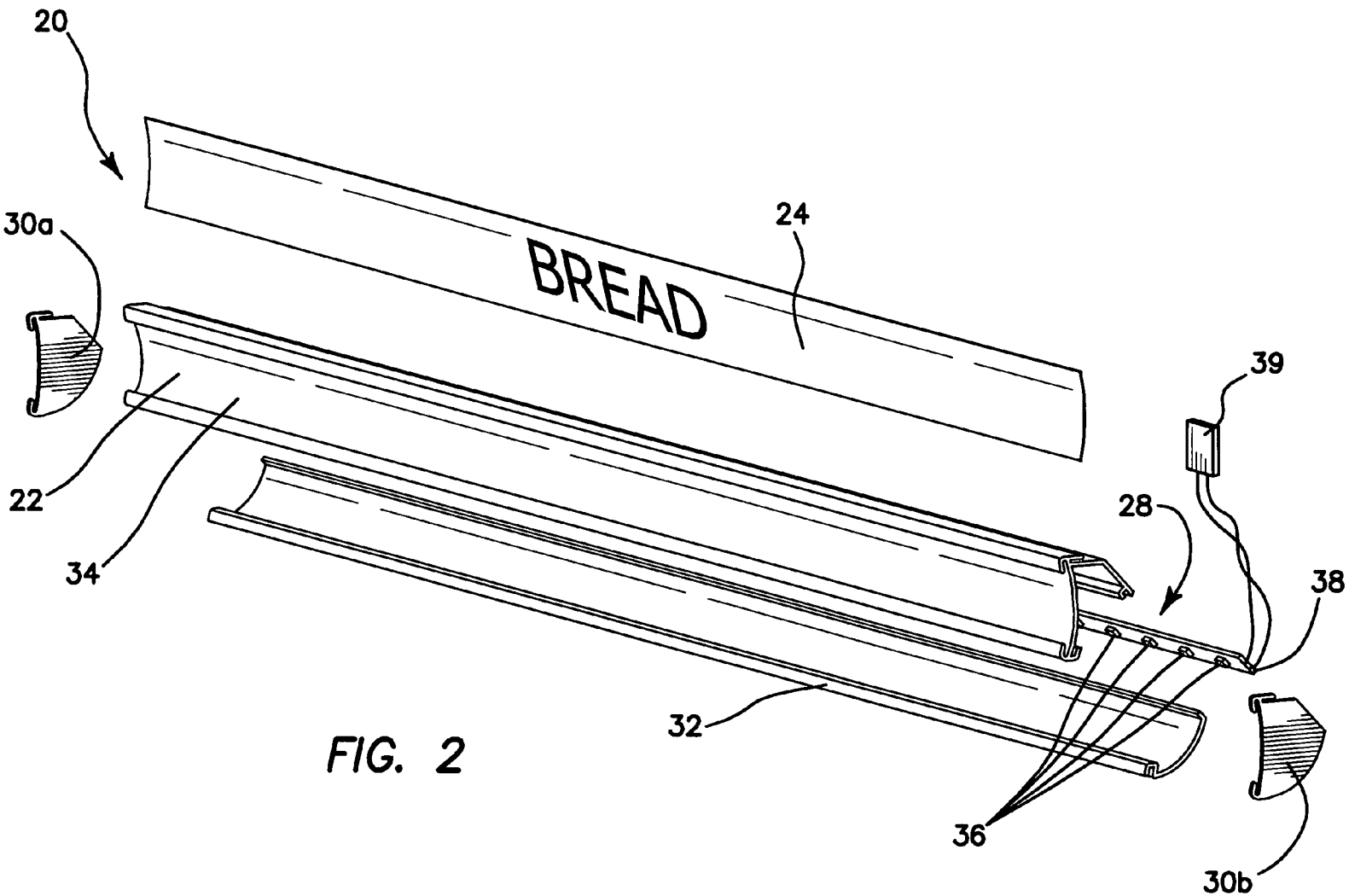
FIG. 2 is an exploded perspective view of one of the present label holders illustrated in FIG. 1.

A more detailed view of label holder 20 is illustrated in FIG. 2. The label holder 20 includes a label retention member 22, a label 24, and an illumination source 28. The illustrated embodiment of the label holder 20 also optionally includes a first end cap 30*a*, a second end cap 30*b*, and a light transmission element 32. The components of the label holder 20 are preferably translucent and/or transparent to permit light emitted from the illumination source to provide backlit illumination of the labels. In at least one embodiment, the label retention member 22 is a translucent white acrylic extrusion member, and the light transmission element 32 is a transparent or clear acrylic extrusion member. As discussed herein, including a light transmission element 32 on the present label holders can provide a desirable illumination of merchandise located below the label holder and can protect the illumination source from damage.

In the embodiment of FIG. 2, the label retention member 22 comprises a label accommodating channel 34. The label accommodating channel 34 is structured to accommodate one or more labels, as described herein. The illumination source 28 is illustrated as including a plurality of light emitting elements, such as light emitting diodes (LEDs), 36 positioned on a circuit board 38. The circuit board 38 may be understood to be a printed circuit board. The circuit board 36 is configured to provide electricity to each of the LEDs 36 from a power source using conventional electronics and circuitry.

Figure 3:
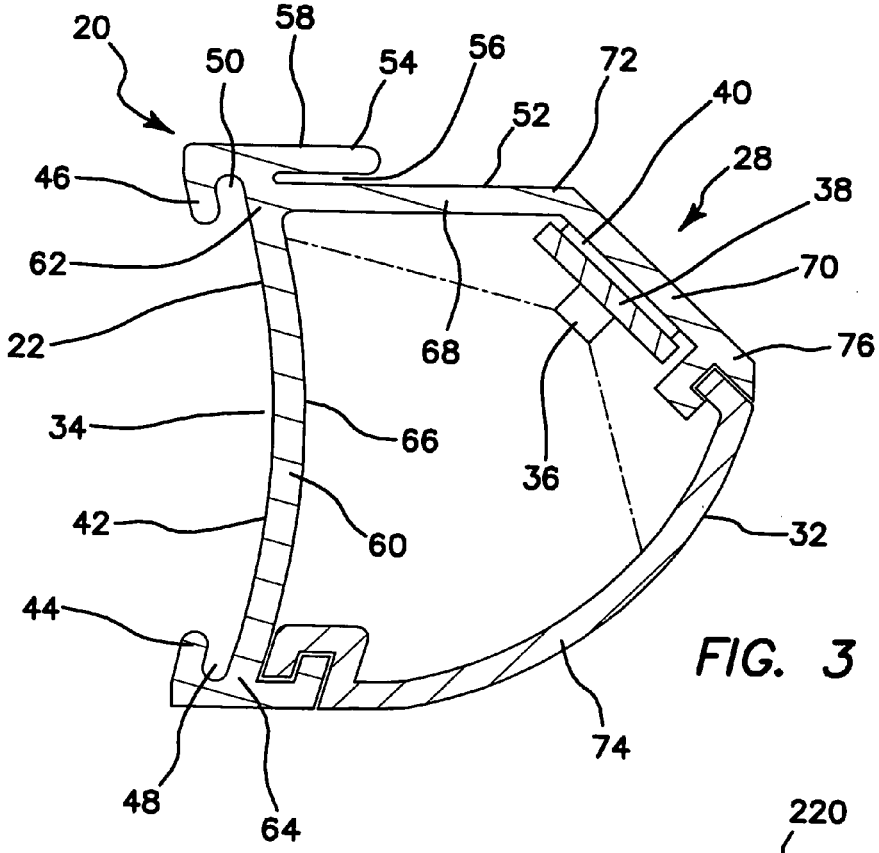
FIG. 3 is a sectional view of one of the present label holders illustrated in FIG. 1.

The label holder 20 is shown in sectional view in FIG. 3. As described herein, the label holder 20 comprises a label retention member 22, which comprises a label accommodating channel 34. The label holder also comprises an illumination source 28 positioned relative to the label retention member 22 to provide backlighting to at least one label located in the label accommodating channel 34. Similar label holders 220, 320, 420, 520, and 620 are described in more detail herein.

In the sectional view of FIG. 3, the illumination source 28 is shown with one light emitting element 36, but it can be understood from FIG. 2, that the illumination source 28 comprises a plurality of light emitting elements 36. In the illustrated embodiment, the illumination source 28 comprises at least one array of light emitting diodes. For example, in FIG. 2, the illumination source 28 comprises a single array of LEDs attached or coupled to a printed circuit board.

Referring back to FIG. 3, the label accommodating channel 34 is formed by a concave surface 42, a lower flange 44 that is spaced apart from the concave surface 42, and an upper flange 46 that extends toward the lower flange 44 and is spaced apart from the concave surface 42. The lower flange 44 and the upper flange 46 are spaced apart from the concave surface 42 to form lower and upper grooves 48 and 50, respectively. The grooves 48 and 50 are dimensioned to receive edge portions of one or more labels, such as label 24 shown in FIG. 2. Thus, it may be understood that the label holder 20 can comprise at least one label 24 located in the label accommodating channel 34.

The label retention member 22 may comprise a planar surface 52 rearwardly extending from the label accommodating channel 34. The planar surface 52 may be understood to be a shelf contact surface of the label retention member 22.

The label holder 20 is also illustrated as comprising a shelf retention member 54 that is structured to secure the label holder along a front edge of a shelf, such as a gondola shelf front edge. The shelf retention member 54 is illustrated as comprising a groove 56 that is dimensioned to receive a portion of the shelf. In reference to the embodiment of FIG. 3, the groove 56 is defined by a flange 58 and planar surface 52.

An example of the present label holders, such as the embodiment illustrated in FIG. 3, may be understood to comprise a label retention member 22 that comprises a first sidewall 60 having an upper end region 62, a lower end region 64, a concave surface 42, and a substantially opposing convex surface 66. The concave surface 42 is a surface of the label accommodating channel 34. The label retention member 22 also comprises a second sidewall 68 rearwardly extending from the upper end region 62 of the first sidewall 60. The second sidewall 68 has an upper shelf contacting surface 52. The label retention member 22 also comprises a third sidewall 70 that downwardly and rearwardly extends from a rearward end 72 of the second sidewall 68 at an angle greater than zero degrees. The illumination source 28 is coupled to a surface of the third sidewall 70. This embodiment may also optionally include a light transmitting fourth sidewall 74 that extends from the lower end region 64 of the first sidewall 60 to a lower end region 76 of the third sidewall 70. In this embodiment, the fourth sidewall 74 is the same component as the light transmission element 32. In certain embodiments, including the illustrated embodiments, the first sidewall, the second sidewall, and the third sidewall are a single extrusion member.

Figure 4:
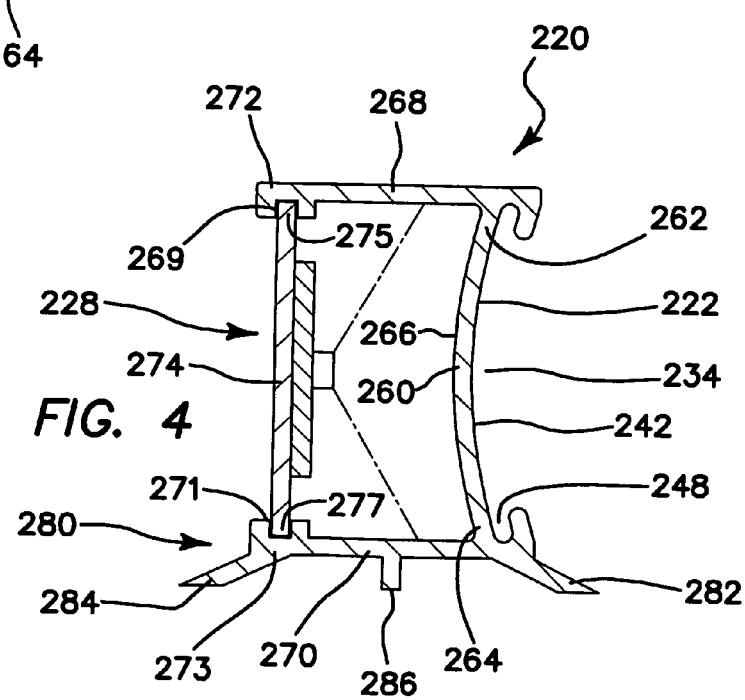
FIG. 4 is a sectional view of an embodiment of the present label holders which is a stand alone sign.

Another embodiment of the present label holders is illustrated in FIG. 4. In this embodiment, the label holder is identified by reference number 220. In the embodiment of FIG. 4, components of the label holder that are similar to the embodiment of FIG. 3 are indicated by like reference numbers increased by 200. The label retention member 222 comprises a first sidewall 260 having an upper end region 262, a lower end region 264, a concave surface 242, and a substantially opposing convex surface 266. The concave surface 242 is a surface of the label accommodating channel 234. The label retention member 222 also comprises a second sidewall 268 rearwardly extending from the upper end region 262 of the first sidewall 260. The second sidewall 268 has a second sidewall groove 269 located at a rearward end region 272 of the second sidewall 268. The label retention member 222 also comprises a third sidewall 270 rearwardly extending from the lower end region 264 of the first sidewall 260. The third sidewall 270 has a third sidewall groove 271 located at a rearward end region 273 of the third sidewall 270. The label holder 220 further includes a fourth sidewall 274. The fourth sidewall 274 is rearwardly spaced apart from the convex surface 266 of the first sidewall 260. A portion 275 of the fourth sidewall 274 is located in the second sidewall groove 269, and a different portion 277 of the fourth sidewall 274 is located in the third sidewall groove 271. The illumination source 228 is coupled to the fourth sidewall 274.

The embodiment shown in FIG. 4 may be understood to be a stand alone sign. Thus, the label holder 220 may also be understood to comprise a base member 280. In this embodiment, the base member 280 includes the third sidewall 270, described above. The base member 280 is an integral component of the label holder 220. The base member 280 is illustrated as including third sidewall 270, and a front leg 282, a rear leg 284, and an intermediate leg 286. Other configurations of the legs and base member 280 are contemplated and within the scope of the present label holders.

Figure 8:
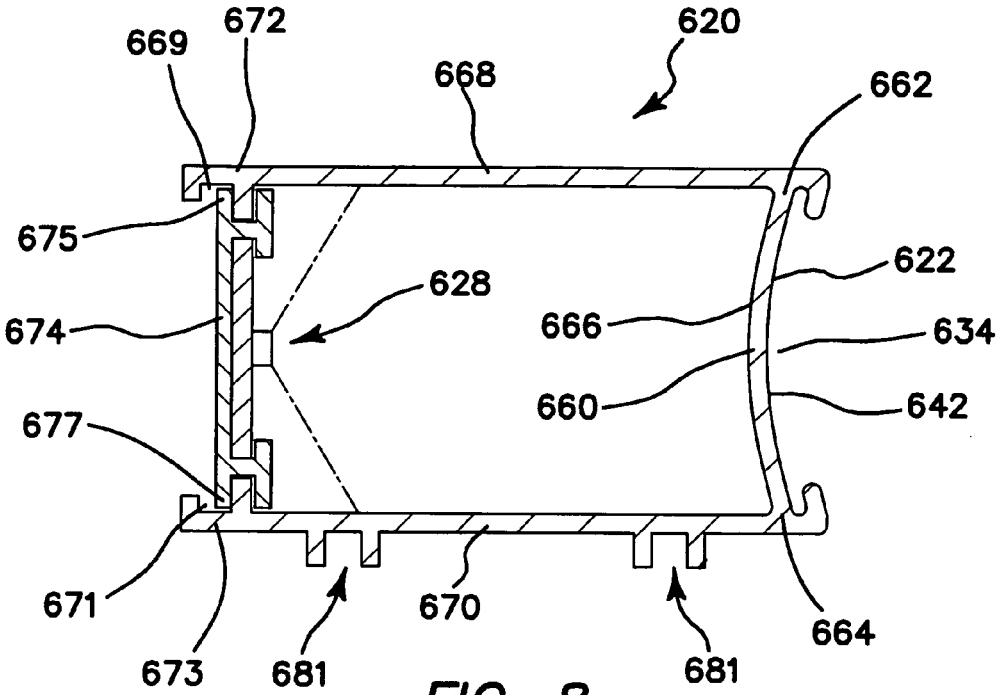
FIG. 8 is a sectional view of an embodiment of the present label holders similar to the embodiment of FIG. 5, but which is a single sided illuminated sign.

An embodiment of the present label holders that is similar to the embodiment of FIG. 4 is illustrated in FIG. 8. The label retention member 622 comprises a first sidewall 660 having an upper end region 662, a lower end region 664, a concave surface 642, and a substantially opposing convex surface 666. The concave surface 642 is a surface of the label accommodating channel 634. The label retention member 622 also comprises a second sidewall 668 rearwardly extending from the upper end region 662 of the first sidewall 660. The second sidewall 668 has a second sidewall groove 669 located at a rearward end region 672 of the second sidewall 668. The label retention member 622 also comprises a third sidewall 670 rearwardly extending from the lower end region 664 of the first sidewall 660. The third sidewall 670 has a third sidewall groove 671 located at a rearward end region 673 of the third sidewall 670. The label holder 620 further includes a fourth sidewall 674. The fourth sidewall 674 is rearwardly spaced apart from the convex surface 666 of the first sidewall 660. A portion 675 of the fourth sidewall 674 is located in the second sidewall groove 669, and a different portion 677 of the fourth sidewall 674 is located in the third sidewall groove 671. The illumination source 628 is coupled to the fourth sidewall 674.

Figure 10:
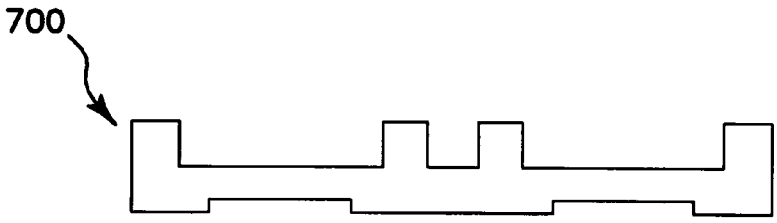
FIG. 10 is a plan view of a base member for certain embodiments of the present label holders.
Figure 11:
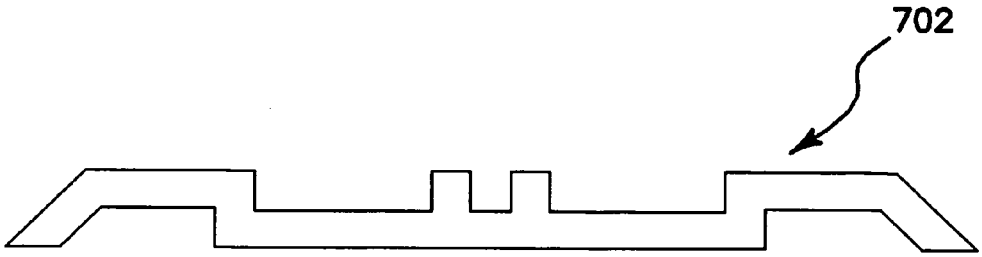
FIG. 11 is a plan view of another base member for certain embodiments of the present label holders.

The embodiment of FIG. 8 may be understood to be a single sided illuminated sign and may is structured for placement on a shelf, such as a gondola shelf. For example, the label holder 620 may be understood to be a gondola shelf end cap label holder. The label holder 620 includes two attachment devices 681 which are shown as a plurality of legs or extensions forming a channel or groove. The attachment devices 681 can be constructed to be attached to a portion of a shelf, or attached to a separate base member, such as the base member 700 shown in FIG. 10 or the base member 702 shown in FIG. 11.

Figure 6:
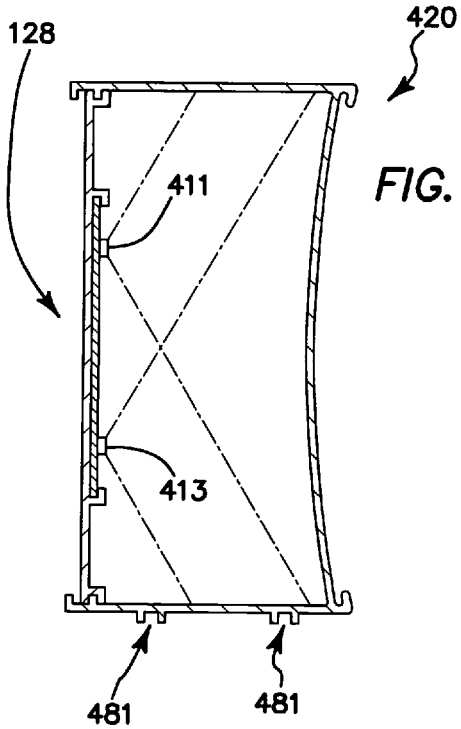
FIG. 6 is a sectional view of an embodiment of the present label holders which is a single sided illuminated sign including two vertically spaced apart rows of illuminators.

Another embodiment of the present label holders in shown in FIG. 6. The embodiment of FIG. 6 is similar to the embodiment of FIG. 8 except the label holder 420 of FIG. 6 comprises an illumination source 428 that comprises two spaced apart rows 411 and 413 of a plurality of LEDs. As shown in the figures, the label holder 420 can be seen to have a height that is greater than the height of the label holder 620 of FIG. 8. As an example, the label holder 420 can be understood to be a single sided illumination sign with a height of about 4.250 inches or a label accommodating channel dimensioned to receive labels having a height of 4.250 inches. In comparison, the label holder 620 can be understood to be a single sided illumination sign with a height of about 2.125 inches or a label accommodating channel dimensioned to receive labels having a height of 2.125 inches.

The embodiment of FIG. 6 may also be understood to be a single sided illuminated sign and may is structured for placement on a shelf, such as a gondola shelf. For example, the label holder 420 may be understood to be a high gondola end cap label holder. The label holder 420 includes two attachment devices 481 which are shown as a plurality of legs or extensions forming a channel or groove. The attachment devices 481 can be constructed to be attached to a portion of a shelf, or attached to a separate base member, such as the base member 700 shown in FIG. 10 or the base member 702 shown in FIG. 11.

Figure 5:
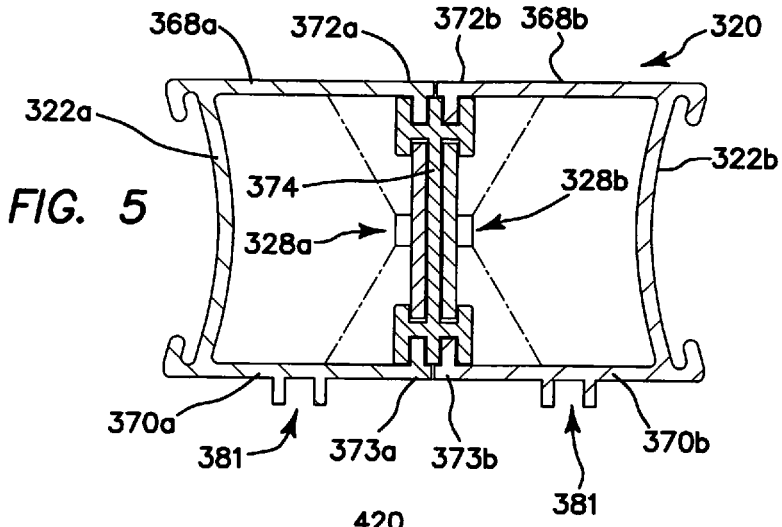
FIG. 5 is a sectional view an embodiment of the present label holders which is a double sided illuminated sign.

Another embodiment of the present label holders is illustrated in FIG. 5. This embodiment of label holder 320 may be understood to be a double sided illuminated label holder. For example, label holder 320 is illustrated as comprising first and second identically structured label retention members 322*a* and 322*b*. The first and second label retention members 322*a* and 322*b* are oriented such that the rearward end region 372*a* of the second sidewall 368*a* of the first label retention member 322*a* is adjacent the rearward end region 372*b* of the second sidewall 368*b* of the second label retention member 322*b*. The rearward end region 373*a* of the third sidewall 370*a* of the first label retention member 322*a* is adjacent the rearward end region 373*b* of the third sidewall 370*b* of the second label retention member 322*b*. The fourth sidewall 374 is connected to both the first label retention member 322*a* and the second label retention member 322*b*. The first illumination source 328*a* is attached to one surface of the fourth sidewall 374 and the second illumination source 328*b* is attached to the opposing surface of the fourth sidewall 374. Similar to the embodiment of FIG. 8, the label holder 320 may be understood to have a height of about 2.125 inches or have a label accommodating channel dimensioned to receive labels having a height of 2.125 inches.

The embodiment of FIG. 5 may be understood to be a double sided illuminated sign and is structured for placement on a shelf, such as a gondola shelf. For example, the label holder 320 may be understood to be a merchandising sign on double sided gondola isles and a product locator. The label holder 320 includes two attachment devices 381 which are shown as a plurality of legs or extensions forming a channel or groove. The attachment devices 381 can be constructed to be attached to a portion of a shelf, or attached to a separate base member, such as the base member 700 shown in FIG. 10 or the base member 702 shown in FIG. 11.

Figure 7:
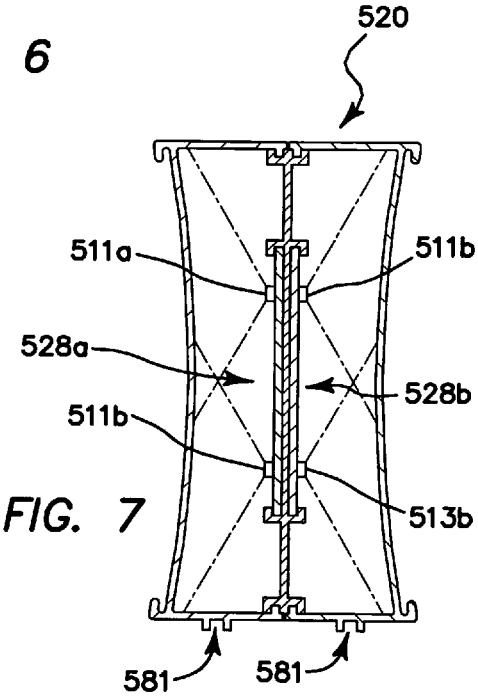
FIG. 7 is a sectional view of an embodiment of the present label holders which is a double sided illuminated sign similar to FIG. 6.

Another embodiment of the present label holders is shown in FIG. 7. The embodiment of FIG. 7 is similar to the embodiment of FIG. 5 except the label holder 520 of FIG. 7 comprises first and second illumination sources 528*a* and 528*b* that each comprise two spaced apart rows 511*a* and 513*a*, and 511*b* and 513*b* of a plurality of LEDs. As shown in the figures, the label holder 520 can be seen to have a height that is greater than the height of the label holder 320 of FIG. 5. As an example, the label holder 520 can be understood to be a double sided illumination sign with a height of about 4.250 inches or a label accommodating channel dimensioned to receive labels having a height of 4.250 inches.

The embodiment of FIG. 7 may be understood to be a double sided illuminated sign and is structured for placement on a shelf, such as a gondola shelf. For example, the label holder 520 may be understood to be a gondola shelf merchandising locator. The label holder 520 includes two attachment devices 581 which are shown as a plurality of legs or extensions forming a channel or groove. The attachment devices 581 can be constructed to be attached to a portion of a shelf, or attached to a separate base member, such as the base member 700 shown in FIG. 10 or the base member 702 shown in FIG. 11.

Thus, embodiments of the present label holders may further comprise a base member removably attached to a third sidewall of the label holders.

The present label holders are placed, attached, or coupled to merchandise shelving assemblies. Therefore, the present invention encompasses merchandise shelving assemblies or other displays that comprise at least one of the label holders described herein.

In addition, embodiments of the invention relate to a method of producing a merchandise shelving assembly that comprises placing any of the present label holders on a shelf of a merchandise shelving assembly.

The present label holders are produced by securing the components of the label holders together. The components of the label holders can be produced using conventional methods and techniques known to persons of ordinary skill in the art. For example, the label retention member 22 and the light transmission element 32 can be produced by extruding plastic materials into a desired physical configuration, including those configurations described herein. The illumination source can be adhered to the label retention member or a sidewall of the label holder using an adhesive, one or more magnets, or other fasteners.

As one example, the extrusions, such as the label retention member 22 and the light transmission element 32 can be obtained from a company, such as Jet Plastics (Los Angeles, Calif.). The illumination source, such as the printed circuit boards which comprise the LEDs can be obtained from a company, such as DURLED Lighting Technologies. Corp. (Irvine, Calif.). The end caps 30*a* and 30*b* can be obtained from a company, such as COMM CON Connectors, Inc. (Duarte, Calif.). The electronic connectors and pins can be obtained from a company, such as MOLEX (Lisle, Ill.).

The illumination source can be adhesively secured to the label retention member, and an additional extruded sidewall member, such as the light transmitting element 32 or the fourth sidewalls 274, 374, and 674, can be attached to the label retention member to form an enclosed cavity containing the illumination source. Endcaps can be attached to the ends of the assembled label holder. The label holder can then be attached to a front edge of a gondola shelf or may be mounted on or near merchandise products using a base member, which can be integrally formed or removably attached to the label holder. Labels can be inserted into the label accommodating channel, as desired. When the label holder is attached to the front edge of the shelf, the attachment can be a pressure fit, by sliding the front edge of the shelf in a groove of the label holder, or the attachment can be by an adhesive, one or more magnets, or other suitable fasteners.

Figure 9:
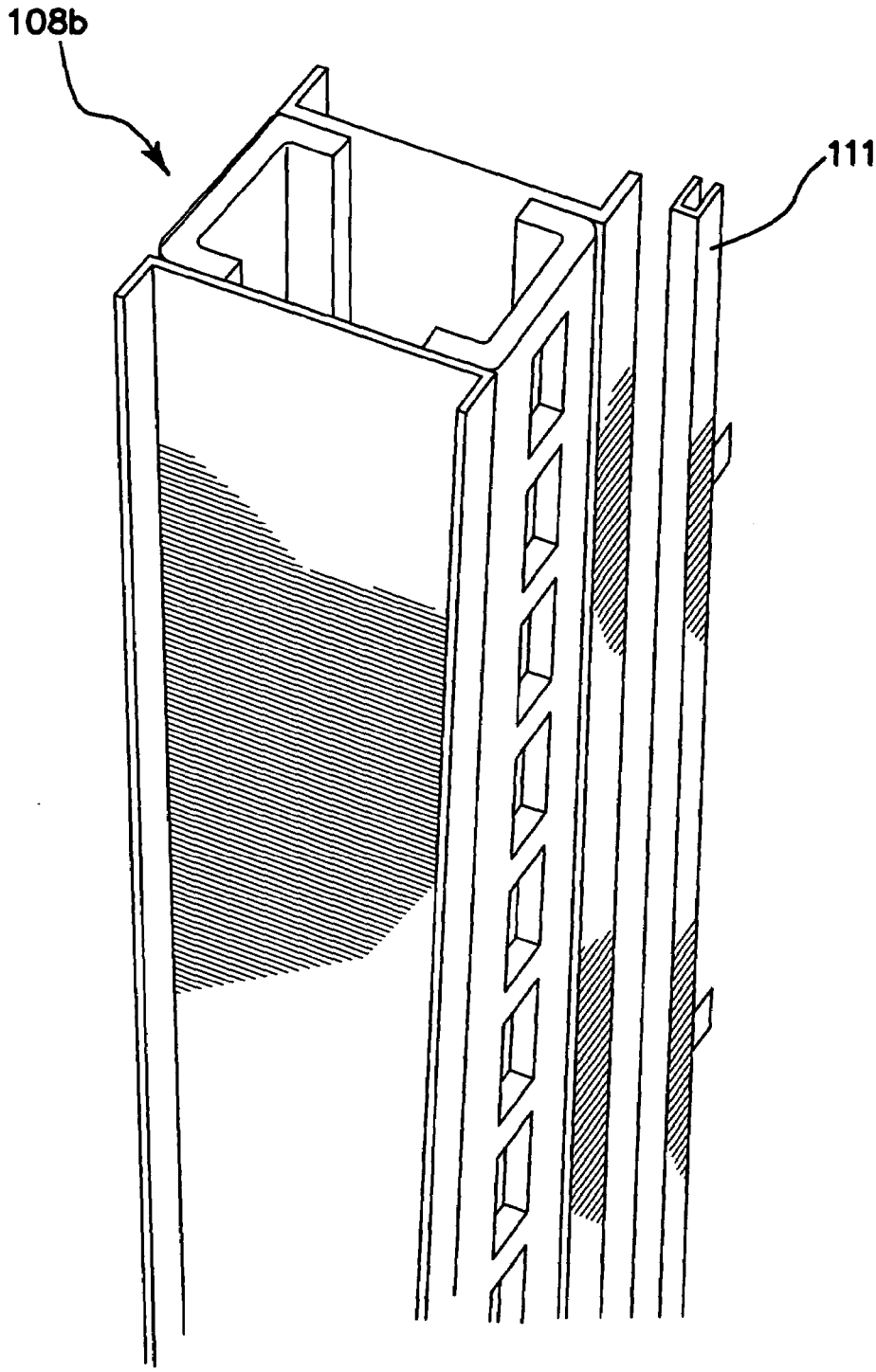
FIG. 9 is a perspective view of a portion of a gondola shelf vertical upright and a connector strip.

The illumination source includes an electrical connector 39, as shown in FIG. 2. The electrical connector 39 connects to a connector extending from a connector strip 111 (see FIG. 9). Low voltage power can be supplied to the printed circuit boards by step down transformers with input 110/220 volt AC to output 12 volt DC or 24 volt DC then distributed to the connector strips 111.

The label holders and merchandise shelving assemblies are used by placing one or more labels in the label holders and illuminating at least a portion of the label holders using the illumination sources described herein.

In view of the disclosure herein, it can be appreciated that the present label holders and related devices, systems, and methods can enhance a consumer's shopping experience, can enhance sales of desired merchandise, and provide other benefits to merchants and consumers.

In addition, and unlike the merchandise restocking and repricing system disclosed in U.S. Pat. Pub. No. 2002/0147597, embodiments of the present label holders, and related devices, systems, and methods, do not include a hand-held unit which remotely causes the label holder to illuminate under predetermined conditions. Furthermore, embodiments of the present systems can provide backlit illumination of labels provided on or in the present label holders, and can provide illumination of merchandise located on a nearby shelf, such as a shelf below the label holder.

A number of publications, patents, and patent applications have been cited hereinabove. Each of the cited publications, patents, and patent applications are hereby incorporated by reference in their entireties.

While this invention has been described with respect to various specific examples and embodiments, it is to be understood that the invention is not limited thereto and that it can be variously practiced with the scope of the following claims. Multiple variations and modifications to the disclosed embodiments will occur, to the extent not mutually exclusive, to those skilled in the art upon consideration of the foregoing description. For example, various components of the present label holders can be colored to enhance the consumer's shopping experience or to enhance sale of desired merchandise. In certain embodiments, the label retention member is formed of a colored plastic. In other embodiments, the illumination source can comprise multiple colored light emitting elements, including combinations of different colors. Additionally, other combinations, omissions, substitutions and modifications will be apparent to the skilled artisan in view of the disclosure herein. Accordingly, the present invention is not intended to be limited by the disclosed embodiments, but is to be defined by reference to the appended claims.

What is claimed is:

1. A label holder, comprising:

a label retention member comprising a label accommodating channel, a first sidewall having an upper end region, a lower end region, a concave surface, and a substantially opposing convex surface, the concave surface being a surface of the label accommodating channel, a second sidewall rearwardly extending from the upper end region of the first sidewall, the second sidewall having an upper shelf contacting surface, and a third sidewall downwardly and rearwardly extending from a rearward end of the second sidewall at an angle greater than 0 degrees; and an illumination source coupled to a surface of the third sidewall and positioned relative to the label retention member to provide backlighting to at least one label located in the label accommodating channel.

2. The label holder of claim 1, wherein the illumination source comprises a plurality of light emitting elements.

3. The label holder of claim 1, wherein the illumination source comprises at least one array of light emitting diodes.

4. The label holder of claim 1, wherein the label accommodating channel is formed by a concave surface, a lower flange spaced apart from the concave surface, and an upper flange extending toward the lower flange and spaced apart from the concave surface.

5. The label holder of claim 1, further comprising at least one label located in the label accommodating channel.

6. The label holder of claim 1, wherein the label retention member further comprises a planar surface rearwardly extending from the label accommodating channel.

7. The label holder of claim 1, further comprising a shelf retention member structured to secure the label holder along a front edge of a shelf.

8. The label holder of claim 7, wherein the shelf retention member comprises a groove dimensioned to receive a portion of the shelf.

9. The label holder of claim 1, further comprising a light transmitting fourth sidewall extending from the lower end region of the first sidewall to a lower end region of the third sidewall.

10. The label holder of claim 1, wherein the first sidewall, the second sidewall, and the third sidewall are a single extrusion member.

11. A label holder comprising:

a label retention member including a label accommodating channel, a first sidewall having an upper end region, a lower end region, a concave surface, and a substantially opposing convex surface, the concave surface being a surface of the label accommodating channel; a second sidewall rearwardly extending from the upper end region of the first sidewall, the second sidewall having a second sidewall groove located at a rearward end region of the second sidewall; a third sidewall rearwardly extending from the lower end region of the first sidewall, the third sidewall having a third sidewall groove located at a rearward end region of the third sidewall; and a fourth sidewall rearwardly spaced apart from the convex surface of the first sidewall, a portion of the fourth sidewall being located in the second sidewall groove and a different portion of the fourth sidewall being located in the third sidewall groove; and an illumination source, coupled to the fourth sidewall and positioned relative to the label retention member to provide backlighting to at least one label located in the label accommodating channel.

12. The label holder of claim 11, wherein the illumination source comprises two spaced apart rows of a plurality of light emitting diodes.

13. A label holder comprising:

first and second identically structured label retention members, each label retention member including a label accommodating channel, the first and second label retention members being oriented such that a rearward end region of a second sidewall of the first label retention member is adjacent a rearward end region of a second sidewall of the second label retention member, and a rearward end region of a third sidewall of the first label retention member is adjacent a rearward end region of a third sidewall of the second label retention member, and a fourth sidewall couples the first and second label retention members to each other; and an illumination source comprising a plurality of light emitting diodes positioned relative to the label retention member of at least one of the first and second label retention members to provide backlighting to at least one label in the label accommodating channel of the at least one of the first and second label retention members, wherein the illumination source comprises two spaced apart rows of the plurality of light emitting diodes.

14. The label holder of claim 13, further comprising a base member removably attached to the third sidewall.

15. A merchandise shelving assembly comprising at least one label holder according to claim 1.

16. A method of producing a merchandise shelving assembly, comprising placing the label holder according to claim 1 on a shelf of the merchandise shelving assembly.

17. The label holder of claim 11 wherein the illumination source comprises a plurality of light emitting diodes.

* * * * *